United States Patent [19]

Sheldon et al.

[11] 4,369,609

[45] Jan. 25, 1983

[54] PREFABRICATED BUILDING SYSTEM

[76] Inventors: Robert W. Sheldon, 560 Carriage Dr., NE., Atlanta, Ga. 30328; Richard W. Mullin, Fox Ridge Rd., Eufaula, Ala. 36027

[21] Appl. No.: 178,953

[22] Filed: Aug. 18, 1980

[51] Int. Cl.[3] ..... E04B 5/52

[52] U.S. Cl. ..... 52/478; 52/521; 52/551; 52/741; 411/387

[58] Field of Search ..... 52/478, 521, 548, 551, 52/537, 520, 741; 411/387, 411, 424, 378, 386

[56] References Cited

U.S. PATENT DOCUMENTS

| | | | |
|---|---|---|---|
| 3,869,219 | 3/1975 | Wilson et al. | 411/387 X |
| 3,916,757 | 11/1975 | Wilson | 411/386 |
| 3,998,019 | 12/1976 | Reinwall, Jr. | 52/478 |
| 4,109,437 | 8/1978 | Player et al. | 52/478 X |
| 4,275,541 | 6/1981 | Orals et al. | 411/387 X |

FOREIGN PATENT DOCUMENTS

| | | | |
|---|---|---|---|
| 78515 | 9/1919 | Austria | 411/386 |

*Primary Examiner*—John E. Murtagh

*Assistant Examiner*—Carl D. Friedman

*Attorney, Agent, or Firm*—B. J. Powell

[57] ABSTRACT

A fastener assembly for use in attaching cover panels to support members in a prefabricated building system where the cover panels and support members have a prescribed total thickness at the point of attachment including a self-drilling and self-tapping screw where the self-tapping thread on the screw terminates a prescribed distance from the head of the screw which is substantially equal to the total thickness of the support member and cover panels so that the screw will self-drill and self-tap its way through the support member and the cover panels and the self-tapping thread will release the support member nd the cover panels when the head on the screw is seated against the support member so that the screw is free to rotate with respect to the support member and cover panel; and a locking member adapted to be threadedly engaged by the screw behind the cover panels to clamp the cover panels onto the support member between the locking member and the head of the screw.

6 Claims, 13 Drawing Figures

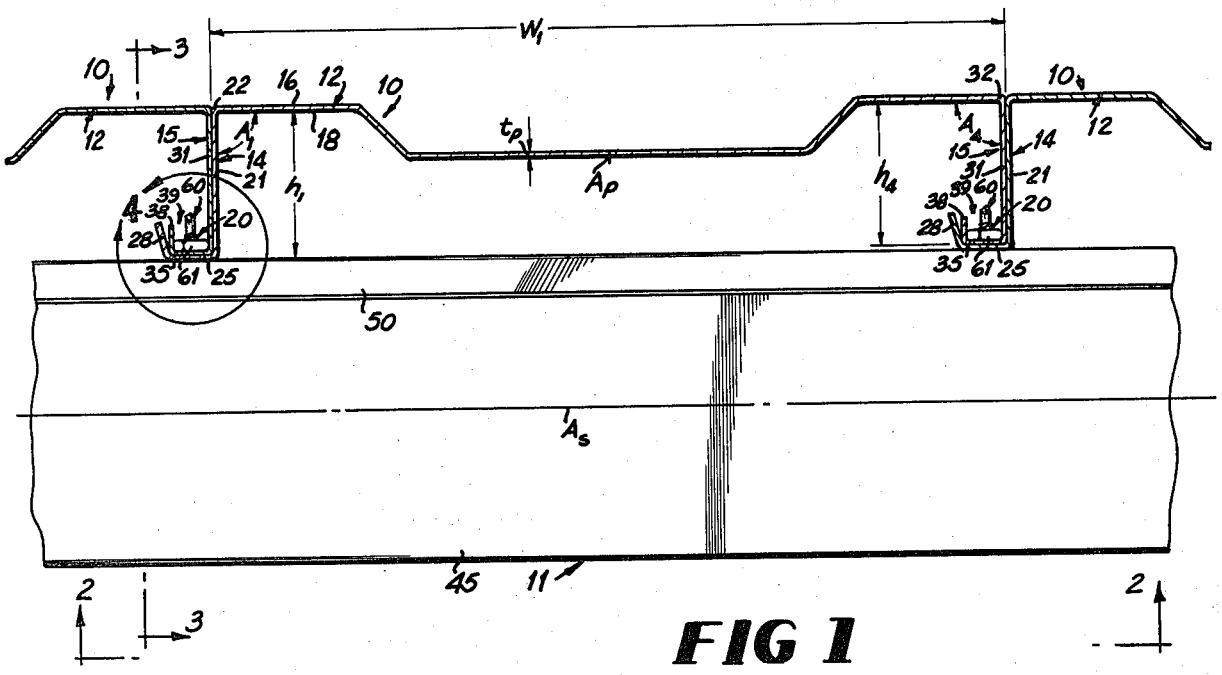
FIG 1
FIG 2
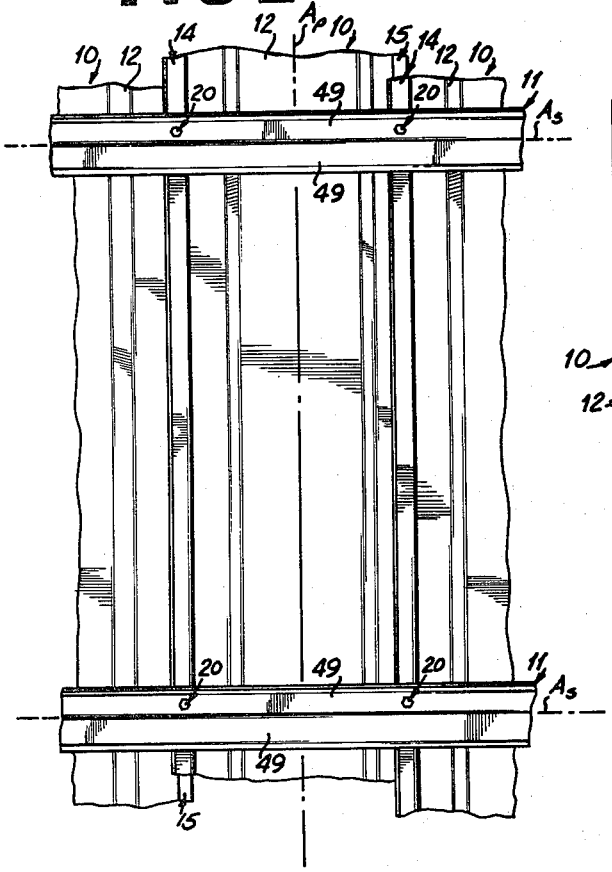
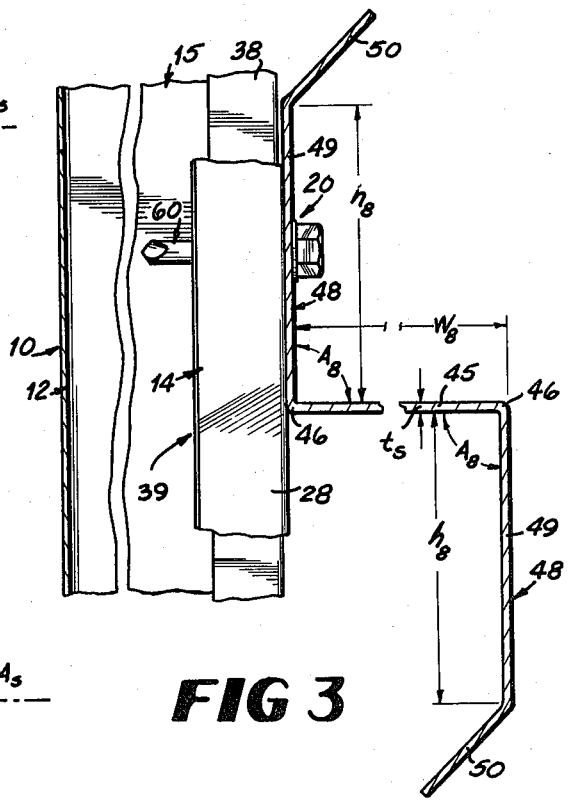
FIG 3

FIG 4
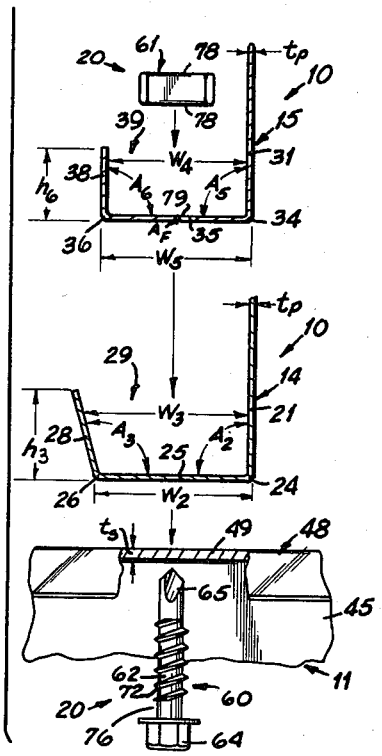
FIG 5
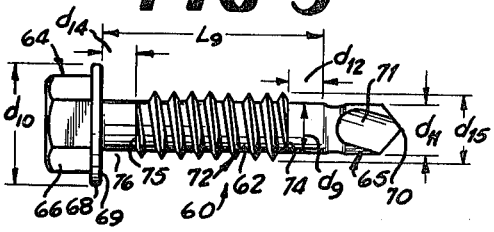
FIG 6
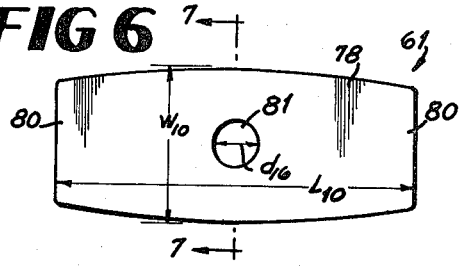
FIG 7
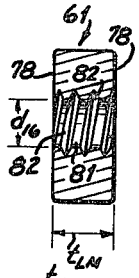
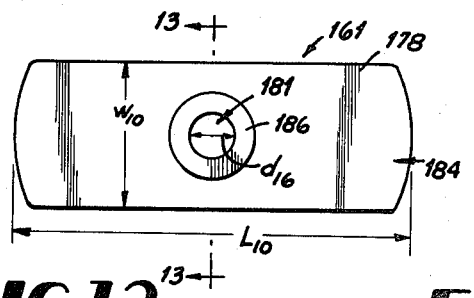
FIG 12
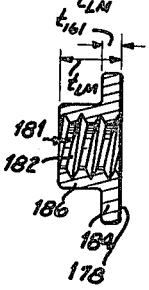
FIG 13
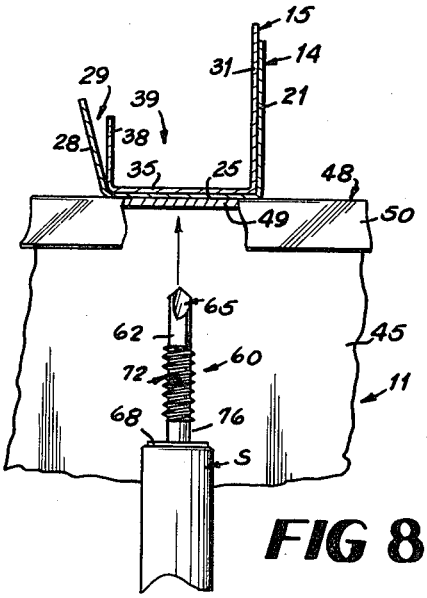
FIG 8
FIG 9
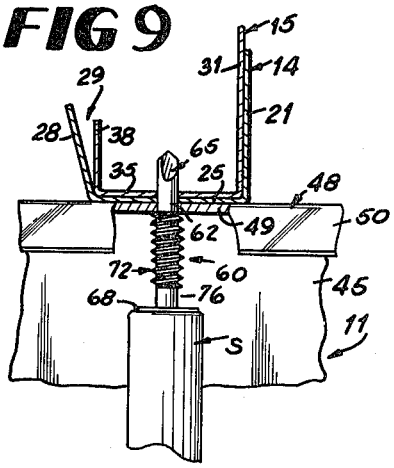

PREFABRICATED BUILDING SYSTEM

BACKGROUND OF THE INVENTION

Prefabricated buildings have gained widespread acceptance as a result of their reduced fabrication costs. These prefabricated buildings commonly have a building framework with spaced apart upstanding side beams and roof beams between which are connected a plurality of generally horizontally extending support members. These horizontally extending support members are commonly known as girts when they are located in the side walls of the building and purlins when they are located in the roof of the building. These support members have exterior covering panels attached thereto to provide the exterior covering of the building. There are two different systems in general use today to attach the exterior cover panels to the girts and purlins of the buildings.

One of these systems allows the fasteners attaching the cover panels to the support members to be located inside the building. This system uses cover panels equipped with side flanges spaced inboard of the exterior section of the cover panels. The side flanges are positioned so that the side flanges of adjacent cover panels can be overlapped and attached to the support member as a unit. Because these side flanges are spaced inboard of the exterior section of the cover panels, the fasteners attaching these panels to the support member are thus located inside the building. This, of course, reduces corrosion since the fasteners are not exposed to the outside environment. In order to use this system, holes are prepunched through the side flanges on the cover panels and through the support members to which the cover panels are to be attached prior to the erection of the building. The panels are positioned so that the holes in the overlapping side flanges are aligned with each other and also aligned with the appropriate hole in the support member so that a bolt can be inserted through the aligned holes and a nut screwed thereon to attach the cover panels to the support member through the overlapping side flanges. One of the problems experienced with this system is that special machinery is required to prepunch the holes through the support members and through the side flanges on the cover panels. Another problem associated with this system is that it is difficult to locate the holes in the side flanges on the cover panels and the support members with sufficient accuracy to insure that the prepunched holes can be aligned during the erection of the building.

The other system in general use today uses cover panels whose edges are overlapped and attached to the support members by installing a fastener from the exterior of the building through the cover panels into the support member. Because it is difficult to determine the location of the support members from the outside of the building once the cover panels are positioned for installation, holes are typically pre-drilled through the cover panels at locations which can be placed in registration with the support members when the cover panels are positioned on the building. The workman then aligns the pre-drilled holes in the cover panels with the support member and typically used self drilling and self-tapping fasteners to form a hole through the support member using the pre-drilled holes in the cover panels as a guide and then screws the fastener into the support member to lock the cover panel onto the support member. One of the disadvantages associated with this system is that it required the pre-drilling of the holes through the cover panel prior to positioning on the building and required that these pre-drilled holes be located with sufficient accuracy to be aligned with the support members once the cover panels are in position. This has created problems in that the support members are not always located with sufficient accuracy to insure that location of the pre-drilled holes on a standard dimension will cause the pre-drilled holes to always be in registration with the support members. Another problem, of course, is that the head of the fastener is exposed to the exterior environment thereby requiring special techniques to reduce the corrosion of the fastener.

SUMMARY OF THE INVENTION

These and other problems and disadvantages associated with the prior art are overcome by the invention disclosed herein and by providing a prefabricated building erection system which does not require preformed holes through the support members and/or the cover panels. The workman drills the holes through the support member and the attachment flanges on the cover panels as in incident to the installation of the fastener in the holes in a single operation, yet the fastener is free to rotate with respect to the support member and attachment flanges on the cover panels when it is in position so that a locking member can be installed on the fastener to clamp the attachment flanges on the cover panels onto the support members to lock them in position.

The erection system of the invention uses a modified self-drilling and self-tapping fastener provided with an unthreaded clearance space under the head of the fastener having a length slightly greater than the combined thicknesses of the attachment flanges on the cover panels and the flange on the support to which the cover panels are attached. The workman simply drives the fastener through the support member and the attachment flanges on the cover panel so that the fastener drills a hole therethrough and the self-tapping threads on the fastener tap through the support member and the attachment flanges on the cover panels as the fastener is being driven therethrough. At about the time the fastener head engages the support member, the unthreaded grip clearance space under the fastener head lines up with the flanges on the support member and the attachment flanges on the cover panels so that the self-tapping threads on the fastener release the support member and the attachment flanges on the cover panels whereupon the fastener is free to rotate with respect thereto. At any time after the drill point on the fastener has penetrated the support member and the attachment flanges on the cover panels, a locking member is inserted over the end of the fastener and held against rotation so that the locking member is threaded onto the threads of the fastener to clamp the cover panels and support member together. The attachment flanges are spaced inboard of the building exterior forming section of the cover panels so that the fastener and locking member are both located on the interior of the building and not exposed to the corrosion promoting outside environment. Thus, the workman can easily visually locate the fastener so that it passes through the support member as well as the overlapped attachment flanges on the cover panels without having to preform any holes.

These and other features and advantages of the invention will become more apparent upon consideration of the accompanying drawings and the following detailed description wherein like characters of reference designate corresponding parts throughout the several views and in which:

BRIEF DESCRIPTION OF THE DRAWINGS

FIG. 1 is a transverse cross-sectional view of a wall section of a building incorporating the invention;

FIG. 2 is a reduced elevational view taken generally along line 2—2 in FIG. 1;

FIG. 3 is an enlarged cross-sectional view taken generally along line 3—3 in FIG. 2;

FIG. 4 is an enlarged exploded view taken generally along line 4—4 in FIG. 2;

FIG. 5 is an enlarged elevational view of the fastener of the invention;

FIG. 6 is an enlarged front elevational view of the locking member of the invention;

FIG. 7 is a transverse cross-sectional view taken generally along line 7—7 in FIG. 6;

FIGS. 8–11 are views taken similarly to FIG. 4 showing the erection of a building using the invention;

FIG. 12 is a front elevational view of an alternate embodiment of the locking member; and FIG. 13 is a transverse cross-sectional view taken generally along line 13—13 in FIG. 12.

DETAILED DESCRIPTION OF ILLUSTRATIVE EMBODIMENTS

Figure 10:
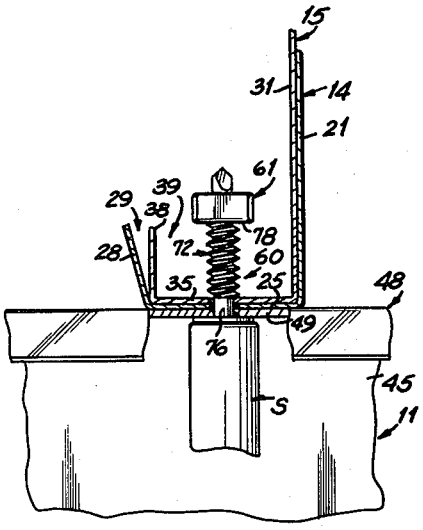

As seen in the figures, the building system embodying the invention includes a plurality of cover panels 10 which are attached to and supported by spaced apart support members 11. The support members 11 are part of the building framework and are supported on the upstanding side beams and roof beams (not shown). The cover panels 10 form the exterior covering of the building. These cover panels 10 may be used to cover the exterior of the side walls of the building or to cover the roof. The support members 11 are usually mounted so that they are generally horizontally oriented while the cover panels 10 are oriented generally normal to the support members 11. Typically, the support members 11 are referred to as girts when they are used in the side walls of the building and as pulins when they are used in the roof of the building.

Referring to FIGS. 1–3, each of the cover panels 10 has a longitudinal axis $A_p$ (FIG. 2) oriented generally normal to the longitudinal axis $A_S$ (FIG. 1) of the support members 11. Each cover panel 10 has a central section 12 equipped with complimentary spacer sections 14 and 15 along opposite sides of the central section 12. The central sections 12 form the exterior of the building while the spacer sections 14 and 15 are used to mount the cover panels 10 on the support members 11.

The spacer sections 14 and 15 have a configuration such that the central section 12 of the cover panel 10 is spaced exteriorly of the support members 11. The spacer sections 14 and 15 also have a complimentary configuration so that the spacer section 14 on one side of each cover panel 10 will nest with the spacer section 15 on the opposite side of another of the cover panels 10 when they are positioned side-by-side to seal the exterior of the building. The nesting spacer sections 14 and 15 are attached to the support members 11 by a fastening assembly 20 which extends through the support member 11 as well as the nesting spacer sections 14 and 15. It will be seen that, because the spacer sections 14 and 15 space the central section 12 of the cover panels 10 exteriorly of the support members 11 and the spacer sections are sealed with respect to each other, the fastening assembly 20 is located interiorly of the building so that the fastening assembly is not exposed to the elements and thus corrosion of the fastening assembly 20 is minimized.

Typically, the cover panels 10 and support members 11 are formed from sheet material with a constant cross-sectional thickness. Thus, cover panel 10 has a cross-sectional thickness $t_p$ (FIG. 1) while the support member 11 has a cross-sectional thickness $t_s$ (FIG. 3). When sheet metal is used, 20–26 gage material is typically used for the cover panels 10, and 12–18 gage material is used for support members 11. Thus, the panel thickness $t_p$ is typically 0.036–0.018 inch while the support member thickness $t_s$ is typically 0.105–0.048 inch. Predominately, 26 gage material is used for panels 10 and 16 gage material is used for support members 11.

The central section 12 has a prescribed width $W_1$ (FIG. 1) along its length and a convenient length so that the panels 10 may be easily handled during the erection of the building. The central section 12 defines the exterior appearance of the building and thus may have a variety of cross-sectional shapes, depending on the desired exterior appearance of the building. The central section 12 has an outside surface 16 which faces exteriorly of the building and an inside surface 18 which faces the interior of the building.

Referring to FIGS. 1 and 4, the spacer section 14 includes a side spacer flange 21 integral with one side edge 22 of the central section 12 of the cover panel 10. The side spacer flange 21 extends along the length of the central section 12 and projects interiorly of the central section 12 so as to define an included angle $A_1$ with the inside surface 18 on the central section 12. The side spacer flange 21 has a projecting height $h_1$ along its length so that the projecting edge 24 on the side spacer flange 21 is generally parallel to the side edge 22 of the central section 12. The angle $A_1$ illustrated is about 90° and the height $h_1$ is about three inches.

An attachment flange 25 is integral with the projecting edge 24 of the side spacer flange 21 and projects outwardly therefrom in the direction away from the panel axis $A_p$ so that the attachment flange 25 is spaced from and extends outwardly of the central section 12 of the panel 10. The attachment flange 25 defines an included angle $A_2$ with the side spacer flange 21, illustrated at 90°, and has a transverse width $W_2$ along its length. The attachment flange 25 extends along the length of the side spacer flange 21. It is the attachment flange 25 that is used to attach the cover panel 10 to the support members 11.

A locating flange 28 is integral with the projecting edge 26 on the attachment flange 25 and projects outwardly therefrom toward the exterior of the building. The locating flange 28 defines an obtuse angle $A_3$ with the attachment flange 25 and extends along the length of the attachment flange 25. The angle $A_3$ is selected to cause a spacer section 15 to nest within the spacer flange 21, attachment flange 25 and locating flange 28 as will become more apparent. The angle $A_3$ illustrated is about 100° as will become more apparent. The locating flange 28 has a convenient height $h_3$ along its length and is illustrated at about 0.63 inch. It will thus be seen that the side spacer flange 21, attachment flange 25 and locating flange 28 define a nesting space 29 therebetween into which the spacer section 15 on another panel 10 can nest as will become more apparent. The nesting space 29 has a width $W_3$ along its bottom adjacent the attachment flange 25 as will become more apparent. This width $W_3$ is illustrated at about 0.94 inch.

As also seen in FIGS. 1 and 4, the spacer section 15 includes a side spacer flange 31 integral with the opposite side edge 32 of the central section 12. The side spacer flange 31 corresponds to the side spacer flange 21 and defines an included angle $A_4$ with the inside surface 18 on the central section 12 with the side spacer flange 31 projecting interiorly of the central section 12. The side spacer flange 31 extends along the length of the central section 12 and has a projecting height $h_4$ along its length that is substantially equal to the height $h_1$ of the side spacer flange 21. Like the side spacer flange 21, the side spacer flange 31 is illustrated with angle $A_4$ at about 90° and height $h_4$ at about three inches. An attachment flange 35 is integral with the projecting edge 34 of the side spacer flange 31 and extends outwardly therefrom in a direction toward the central axis $A_p$ of the cover panel 10 rather than away from the central axis as does the attachment flange 25. The attachment flange 25 defines an included angle $A_5$ with the side spacer flange 31 and has a transverse width $W_5$ along its length substantially equal to the bottom width $W_3$ of the nesting space 29 in the spacer section 14 as will become more apparent. The angle $A_5$ is illustrated at about 90° and the width $W_5$ is illustrated at about 0.94 inch. A locating flange 38 is integral with the projecting edge 36 of the attachment flange 35 and extends along the length thereof. The locating flange 38 defines an included angle $A_6$ with the attachment flange 35 which is illustrated at about 90°. The locating flange 38 also projects toward the exterior of the building and has a convenient height $h_6$ illustrated at about ½ inch. The side spacer flange 31, the attachment flange 35 and the locating flange 38 define a clearance space 39 therebetween which has a clearance width $W_4$ at its bottom adjacent the attachment flange 35.

It will thus be seen that when the cover panels 10 are oriented so that their panel axes $A_P$ are generally parallel and with the spacer section 14 along the edge of each of the cover panels 10 underlying the spacer section 15 on the adjacent cover panel 10 as seen in FIGS. 1–4, the side spacer flange 31, attachment flange 35 and locating flange 38 on the spacer section 15 will nest in the nesting space 29 defined between the side spacer flange 21, the attachment flange 25 and the locating flange 28 on the spacer section 14. The angles $A_3$ and $A_6$ cause the spacer section 15 to positively seat in the spacer section 14 as the attachment flanges 35 and 24 are forced together by the fastening assembly 20. This serves to both positively locate the cover panels 10 with respect to each other and also to provide a seal between the spacer sections 14 and 15. It will also be noted that the clearance space 39 is now located interiorly of the building when the nesting panels 10 are placed against the support members 11 as will become more apparent.

As best seen in FIGS. 1 and 3, the support members 11 each have a central web 45 which extends along the length thereof with a generally rectilinear shape. The central web 45 has a width $W_8$ along its length illustrated at about six inches. Each of the opposed side edges 46 of the central web 45 has integrally mounted thereon a mounting flange section 48 which serves to both reinforce the support member 11 and provide a means for attaching the support member 11 both to the beams in the building framework and the cover panels 10. It will be seen that one of the mounting flange sections 48 projects outwardly from the central web 45 in one direction generally normal to the central web 45 while the other mounting flange section 48 projects outwardly from the central web 45 in the opposite direction generally normal to the central web 45. Each of the mounting flange sections 48 includes a mounting flange 49 integral with the side edge 46 of the central web 45 and extending along the length of the central web 45. The side flange 49 defines an included angle $A_8$ with the central web 45 and has a projecting height $h_8$ along its length. The angle $A_8$ is illustrated at about 90° to maximize the reinforcement of the central web 45 and has a height $h_8$ of about two inches to provide easy access to the mounting flange 49 for mounting the support member 11 in the building framework or to the cover panels 10. A reinforcing lip 50 is integral with the projecting edge 51 on the side flange 49 opposite the central web 45 and extends away from the side flange 49 back over the central web 45 at a convenient angle so as to reinforce the side flange 49 to keep it flat.

The support members 11 are attached to the wall beams and roof beams (not shown) in the building framework so that one of the mounting flange sections 48 extends toward the exterior of the building and the side flange 49 thereof is oriented parallel to the plane of the exterior of the building is to lie in. Typically, the support member axis $A_S$ is oriented horizontally. The cover panels 10 are oriented so that their panel axes $A_P$ are generally normal to the support member axes $A_S$. The nesting cover panels 10 are positioned so that the inside surfaces 54 on the attachment flanges 25 of the spacer sections 14 lie against the outside surface 55 on the side flange 49. The fastening assemblies 20 are then used to attach the side flanges 49 on the support members 11 to the nesting attachment flanges 25 and 35 on the spacer sections 14 and 15 of the cover panels 10 to mount the cover panels 10 on the support members 11 and thus form the exterior of the building as illustrated in FIG. 1.

The fastening assembly 20 includes a self-drilling and tapping fastener 60 and a locking member 61 which is threadedly engaged by the fastener 62 to attach the cover panels 10 to the support members 11. The fastener 60 as seen in FIG. 5 includes a cylindrical shank 62 with an enlarged head 64 integral with one end of the shank and a drill tip 65 integral with the opposite end of the shank. The shank 62 has a length $L_9$ with a constant diameter $d_9$ along its length. The head 64 is provided with appropriate wrenching surfaces 66 thereon for use in installing the fastener together with a locating flange 68 around the base of the head 64 so that the tool used to install the fastener 60 can exert the necessary axially directed forces on the fastener 60 to cause it to drill appropriate holes through the flange 49 on support member 11 and the flanges 25 and 35 on the cover panels 10 as will become more apparent. The head 64 has an outside diameter $d_{10}$ so that the underside 69 of the head 64 will bear against the flange 49 on the support member 11 as will become more apparent.

The drill tip 65 is coaxial with the shank 62 and defines a drill point 70 on the projecting end thereof. Tip 65 defines short flutes 71 therein which cooperate with the drill point 70 to drill a hole through the material in which the fastener 60 is to be installed as will become more apparent. The drill tip 65 has an outside diameter $d_{11}$ substantially equal to the diameter $d_9$ of the shank 62 so that the hole drilled through the material in which the fastener 60 is installed will just receive the shank 62 therethrough.

The shank 62 has a self-tapping thread 72 thereon with a leading end 74 located a distance $d_{12}$ from the leading end of the shank 62 and extending helically around the shank 62 to a trailing end 75 located a distance $d_{14}$ forwardly of the underside 69 of head 64. The self-tapping thread 72 has a cross-sectional shape and size conforming to that associated with self-tapping fasteners with a crest diameter $d_{15}$ such that the threads 72 will self tap into the material through which the drill tip 65 has formed a hole as the fastener 60 is rotated into position. Typically, the thread 72 is a right hand thread so that the thread 72 forces the fastener 60 toward an installed position as the fastener 60 is rotated clockwise when viewed from the head end of the fastener. The distance $d_{14}$ is selected to be greater than the combined thicknesses of the attachment flange 49 on the support member 11 and the nesting flanges 25 and 35 on the cover panels 10 and thus forms a grip clearance space 76 around the shank 62 between trailing end 75 of thread 72 and the underside 69 of head 64.

While the size of the fastener 60 may vary depending on the sizes of the support members 11 and cover panels 10, a fastener 60 conforming to the size commonly known as a No. 12–14 screw has been found satisfactory. This means that the thread 72 has a crest diameter $d_{15}$ of about 0.216 inch while the shank 62 has a diameter $d_9$ of about 0.0160 inch. The head diameter $d_{10}$ is about 0.4 inch while the distance $d_{12}$ from the leading end 74 of thread 72 to the leading end of the shank 62 is about 0.125 inch. Where the panels 10 are made of 26 gage material with a panel thickness $t_P$ of about 0.02 inch, and where the support member 11 is made of 16 gage material with the support member thickness $t_S$ being about 0.06 inch, a distance $d_{14}$ between the trailing end 75 of the thread 72 and the underside 69 of head 64 of about 0.125 inch has been found satisfactory as will become more apparent.

The locking member 61 as seen in FIGS. 6 and 7 has a generally elongate shape with a width $W_{10}$ and a length $L_{10}$. The locking member 61 further has a thickness $t_{LM}$. The width $W_{10}$ of the locking member 61 is selected to be less than the width $W_6$ of the clearance space 39 behind the attachment flange 35 on the spacer section 15 while the length $L_{10}$ of the locking member 61 is selected to be greater than the width $W_6$ behind the attachment flange 35 of the spacer section 15. In this manner, it will be seen that, when the longitudinal axis $A_{LM}$ of the locking member 61 is located so that it is generally coaxial with the axis $A_f$ of the attachment flange 35 on the spacer section 15, the locking member 61 will lay in the clearance space 39 behind the attachment flange 35 on the spacer section 15 with one of the side surfaces 78 on the locking member 61 lying against the rear surface 79 on the attachment flange 35. Because the length $L_{10}$ of the locking member 61 is greater than the width $W_6$ of the clearance space 39, opposite end portions 80 of the locking member 61 will engage the locating flange 38 and/or the side spacer flange 31 of the spacer section 15 to prevent rotation of the locking member 61 as will become more apparent.

The locking member 61 seen in FIGS. 6 and 7 is provided with a hole 81 centrally therethrough oriented perpendicular to the longitudinal axis $A_{LM}$ and the side surfaces 78. The hole 81 has a diameter $d_{16}$ slightly larger than the shank diameter $d_9$ of the fastener 60 so that the shank 62 can just be inserted through the hole 81 with the shank 62 maintaining the locking member 61 oriented normal to the fastener 60. The hole 81 seen in FIGS. 6 and 7 is internally threaded with a female thread 82 complimentary to the thread 72 on the fastener 60 so that the fastener 60 can be screwed into the locking member 61.

The thickness $t_{LM}$ of the locking member 61 is selected to provide sufficient engagement between the thread 72 on the fastener 60 and the locking member 61 so that a minimum tensile pull out strength between the fastener 60 and the locking member 61 is maintained. Usually, this minimum pull out strength is specified at about 700 pounds. Where the fastener 60 is a size 12–14 size, a thickness $t_{LM}$ of about 0.19 inch causes the locking member 61 to engage about two flights of the thread 72 to maintain a pull out strength of about 2000 pounds. This insures that the minimum pull out strength is exceeded with an adequate margin of safety.

To install the cover panels 10 on the support members 11, the workman positions the cover panels 10 so that the spacer section 15 on each cover panel 10 nests in the spacer section 14 on the adjacent cover panel 10. The cover panels 10 are positioned so that the overlapped and nesting spacer sections 14 and 15 are located adjacent the exteriorly facing side flange 49 on the support member 11. The cover panels 10 are held in this position by clamps or other means. With the cover panels 10 thusly held as seen in FIG. 8, the fastener 60 is placed in a conventional driver whose socket S partly seen in FIG. 8 so that the fastener 60 is held coaxially of the socket S and the drill tip 65 projects forwardly of the socket S. With the fastener 60 thusly held, the workman locates the drill point 70 on the fastener 60 on the inside surface 56 of the side flange 49 on support member 11 so that the fastener 60 is in registration with the overlapped flanges 25 and 35 on panels 10 lying against the outside surface 55 on flange 49. While keeping the fastener 60 so that its central axis is generally perpendicular to the flange 49, the workman activates the driver to rotate the socket S and fastener 60. At the same time, the workman forces the driver toward the flange 49 to cause the drill tip 65 on the fastener 60 to drill aligned holes H through the side flange 49 on support member 11 and then through the overlapped flanges 25 and 35 therebehind as seen in FIG. 9. After the drill tip 65 has drilled the holes through the side flange 49 on the support member 11 and the overlapped attachment flanges 25 and 35 on the cover panels 10, the leading end of the shank 62 moves into the thusly formed holes H as seen in FIG. 9 so that the shank 62 locates the screw 60 coaxially with the holes.

As the workman continues to force the screw toward the side attachment flange 49, the leading end of the self-tapping thread 72 engages the side attachment flange 49 about the hole H therethrough and the thread 72 self-taps its way through the side flange 49 as well as the attachment flanges 25 and 35 of the nesting spacer sections 14 and 15. As the driver continues to rotate the sockets and thus fastener 60, the thread 72 draws the head 64 of the screw 60 toward the inside surface 56 on the side flange 49. When the trailing end 75 of the thread 72 passes through the side flange 49 and the attachment flanges 25 and 35 on the nesting spacer sections 14 and 15, the side flange 49 as well as the attachment flanges 25 and 35 lie in the grip clearance space 76 between the trailing end 75 of thread 72 and the underside 69 of head 64 as seen in FIG. 10. Since the thread 72 has released the side flange 49 and the overlapped attachment flanges 25 and 35, the fastener 60 is free to rotate in the holes H while the shank 62 keeps the fastener 60 located in the holes. Thus, it will be seen that thread 72 does not serve to hold the flanges 49, 25 and 35 together as will become more apparent. The thread 72 is self-tapping so that it can be driven through the flanges without requiring that the holes H be at least as large as the thread crest diameter $d_{15}$. If, in forcing the drill tip 65 through the attachment flanges 25 and 35, they are forced apart slightly to create a gap therebetween or with the side flange 49 on the support member 11, it will be seen that the self-tapping thread 72 on the screw 60 forces the attachment flanges 25 and 35 back toward the side flange 49 on the support member 11 to reduce the gap.

At any time after the drill tip 64 has formed the holes through the side flange 49 on support member 11 and the attachment flanges 25 and 35 on the nesting spacer sections 14 and 15, the workman may locate the locking member 61 in the clearance space 39 behind the attachment flange 35 and position the locking member 61 to that drill tip 65 extends through hole 81 and the shank 62 is inserted into the holes 81 through the locking member 61 as seen in FIG. 10. Because the drill tip diameter $d_{11}$ is substantially equal to the shank diameter $d_9$, the locking member 61 will pass over the drill tip 65, yet the thread 82 in the locking member 61 will engage the thread 72 on the fastener 60 to positively interconnect same. To place the locking member 61 over the leading end of the shank 62, it will be seen that the workman locates the axis $A_{LM}$ of the locking member 61 so that it is generally coaxial with the axis $A_F$ of the attachment flange 35.

Figure 11:
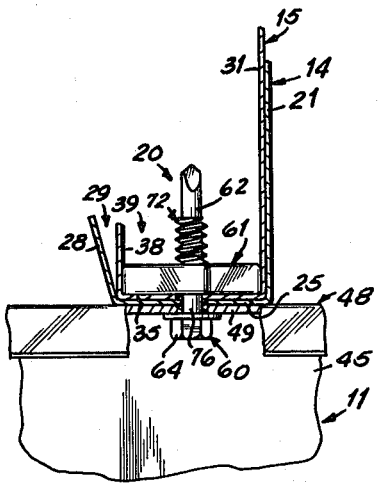

The workman then reactivates the driver so that the socket S rotates the fastener 60 to cause the thread 72 on the fastener 60 to engage the thread 82 on the locking member 61 and screw the fastener 60 into the locking member 61 to force the locking member 61 toward the attachment flange 35. Because the length $L_{10}$ of the locking member 61 is longer than the width $W_6$ of the clearance space 39 behind the attachment flange 35, the end portions 80 of the locking member 61 will engage the side spacer flange 31 and/or the locating flange 38 on the spacer section 15 to limit the turning of the locking member 61 so that the locking member 61 is self wrenching. This is advantageous since the size of the clearance space 39 is sufficiently limited to make access to the locking member 61 with a separate holding tool difficult. Because the width $W_{10}$ of the locking member 61 is less than the width $W_6$ of the clearance space 39, the locking member 61 can still be driven against the attachment flange 35. As the fastener 60 is rotated by the socket S with the thread 72 on the fastener 60 engaging the thread 82 in the locking member 61, the locking member 61 will be tightened thereon so that the side flange 49 and the attachment flanges 25 and 35 will be clamped between the underside 69 of the head 64 and that side surface 78 on the locking member 61 facing the underside 69 of the head 64 to thus connect the cover panels 10 to the support member 11 as seen in FIG. 11. The thickness $t_{LM}$ of the locking member 61 and the grip clearance length $d_{14}$ of the grip clearance space 76 on fastener 60 are selected so that, when the locking member 61 is fully seated against the attachment flange 35, sufficient engagement between the threads 72 and 82 will be maintained to exceed the required minimum pull out strength of the joint.

Because the thread 82 in locking member 61 is complimentary to the thread 72 on fastener 60, the locking member 61 must be appropriately oriented as it is inserted over the fastener 60 so that the threads 72 and 82 will engage. Because the thread 72 is self-tapping, the thread 82 can be omitted so that this orientation is not required. The locking member 61 with an unthreaded hole 81 is inserted over the end of the shank 62 on fastener 60. As the fastener 60 is rotated, the thread 72 self-taps into the locking member 61 and tightens the locking member 61 down against the attachment flange 35 to the same position as that shown in FIG. 11. The self-wrenching feature of the locking member 61 will hold it against rotation so that it will be tightened. By not tapping the thread 82 in the locking member 61, the cost associated with such tapping operation is eliminated.

An alternate embodiment of the locking member is illustrated in FIGS. 12 and 13 and is designated by the numeral 161. The locking member 161 is functionally the same as locking member 61. The locking member 161 has main body 184 with a length $L_{10}$ and width $W_{10}$ corresponding to that of locking member 61. The main body 184 of the locking member 161, however, has a thickness $t_{161}$ which is considerably thinner than that of the member 61. The locking member 161 includes an annular lip 186 projecting outwardly from one side of the main body 184 around the common hole 181 defined through the main body 184 and lip 186. The side surface 178 on the main body 184 opposite lip 186 serves as the working surface for member 161. The hole 181 has a diameter $d_{16}$ corresponding to that of member 61 and the combined thickness $t_{LM}$ of the main body 184 and lip 186 around hole 181 corresponds to the thickness of the locking member 61. This insures that sufficient engagement will be maintained between the locking member 161 and fastener 60 to exceed the minimum required pull out strength while at the same time allowing the main body 184 to be thinner to reduce the weight of the locking member 161 and facilitate fabrication thereof. The locking member 161 can thus be made in a single punching and forming operation that makes hole 181 and lip 186 at the same time.

As seen in FIG. 13, the main body 184 and lip 186 are provided with a thread 182 about hole 181 corresponding to the thread of locking member 61. Thus, the locking member 161 is screwed onto the thread 72 on fastener 60 similarly to locking member 61. It will be appreciated that the side surface 178 on member 161 opposite lip 186 is positioned so that it faces the attachment flange 35 as it is installed. Thus, the lip 186 provides an indicator as to the proper orientation of locking member 161. It will likewise be understood that hole 181 may be left unthreaded and installed as discussed for locking member 61 with an unthreaded hole 81.

What is claimed as invention is:

1. A fastener assembly for use in attaching a plurality of juxtaposed work pieces together where the work pieces have a prescribed total thickness at the point of attachment including:

a screw including a shank; an enlarged head at one end of said shank; a drill tip at the opposite end of said shank; and a self tapping thread around said shank, said self tapping thread having a leading end adjacent said drill tip and a trailing end spaced a prescribed distance from said head substantially equal to the prescribed total thickness of said work pieces, said drill tip adapted to drill holes through said work pieces sized to just receive said shank therethrough so that said self tapping thread will tap through said work pieces as said screw is rotated after said drill tip forms the holes to allow said head on said screw to move toward one side of said work pieces whereby said thread successively releases the work pieces as said head moves toward the one side of the work pieces to cause the work pieces to be clamped together in the juxtaposed position as the trailing end of said thread threadedly passes through that work piece opposite said head and whereby said thread threadedly disengages said work pieces when said head is juxtaposed with the one side of said work pieces so that said screw is free to rotate with respect to said work pieces yet the trailing end of said thread maintains said work pieces clamped together; and a locking member adapted to be threadedly engaged by said thread on said screw and screwed down against the work pieces opposite said head as said screw is rotated with respect to said work pieces to clamp said work pieces between said locking member and said head on said screw.

2. The fastener assembly of claim 1 wherein said locking member defines an unthreaded hole therethrough sized to just receive said shank on said screw so that said self tapping thread on said screw taps into said locking member as said screw is rotated with respect to said locking member so that said thread engages said locking member when the work pieces are clamped between said head on said screw and said locking member.

3. The fastener assembly of claim 1 wherein said locking member defines an internally threaded hole therethrough adapted to threadedly engage said thread on said screw as said fastener is screwed into said locking member so that said thread engages said locking member when the work pieces are clamped between said head on said screw and said locking member.

4. The fastener assembly of claim 1 wherein said distance between the trailing end of said thread and said head on said screw and the size of said locking member are selected so that a prescribed minimum pull out strength is maintained between said screw and said locking member when the work pieces are clamped between said head on said screw and said locking member.

5. A method of attaching building panels to support members on a building where each of the panels has panel edges to overlap the panel edges of adjacent panels comprising the steps of:

placing the panels against the support members so that the panel edges overlap at the support members using self-drilling screws equipped with self tapping threads and defining a threadless grip clearance space under the head of the screw substantially equal to the combined thickness of the support member and the overlapped panel edges, rotatably driving the screws through the support member and the overlapped panel edges of the panels so that each screw first drills a hole through the support member and overlapped panel edges, then the threads on the screw engage the support member and the overlapped panel edges as the screw is driven therethrough and then the threads on the screw release the support member and the overlapped panel edges as the screw head engages the support member so that the screw is freely rotatable with respect to the support member and the overlapped panel edges, yet the trailing end of the threads on the screw maintain the support member and overlapped panel edges in juxtaposition; and threading a locking member onto that end of the screw opposite the head and rotating the screw with respect to the locking member to screw the locking member down onto the screw so that the locking member and screw head clamp the support member and overlapped panel edges therebetween.

6. A prefabricated building system including:

a building framework including a plurality of spaced apart support members, each of said support members including a side flange thereon;

a plurality of cover panels adapted to be positioned in a side-by-side relationship around said building framework and supported on said support members to form an exterior covering therefor, each of said cover panels including at least one attachment flange thereon adapted to overlap another of said attachment flanges on another of said cover panels with said overlapping attachment flanges on the different cover panels in juxtaposition with at least one of said side flanges on said support members; and at least one fastener assembly for attaching said overlapping attachment flanges on said cover panels to one of said side flanges on said support members, said fastener assembly comprising:

a screw including a shank; an enlarged head at one end of said shank; a drill tip at the opposite end of said shank; and a self tapping thread around said shank, said self tapping thread having a leading end adjacent said drill tip and a trailing end spaced a prescribed distance from said head substantially equal to the prescribed total thickness of said side flange on said support member and said overlapping attachment flanges on said cover panels, said drill tip adapted to drill holes through said side flange on said support member and said overlapping attachment flanges on said cover panels sized to just receive said shank therethrough so that said self tapping thread will tap through said side flange on said support member and said overlapping attachment flanges on said cover panels as said screw is rotated after said drill tip forms the holes to allow said head on said screw to move toward one side of said side flange on said support member whereby said thread successively releases the work pieces as said head moves toward the one side of the work pieces to cause the work pieces to be clamped together in the juxtaposed position as the trailing end of said thread threadedly passes through that work piece opposite said head and whereby said thread threadedly disengages said side flange on said support member and said overlapping attachment flanges on said cover panels when said head is juxtaposed with said side flange on said support member so that said screw is free to rotate with respect to said side flange on said support member and said overlapping attachment flanges on said cover panels yet the trailing end of said thread maintains said work pieces clamped together; and a locking member adapted to be threadedly engaged by said thread on said screw and screwed down against said attachment flange opposite said head as said screw is rotated with respect to said locking member to clamp said side flange on said support member and said overlapping attachment flanges on said cover panels between said locking member and said head on said screw.

* * * * *